US005621920A

United States Patent [19]

Gorsuch et al.

[11] Patent Number: 5,621,920

[45] Date of Patent: Apr. 22, 1997

[54] STOCKING CAP WITH TAIL SERVING AS A WRAP-AROUND END-ATTACHABLE SCARF AND/OR SKI MASK

[76] Inventors: Gary Gorsuch, 6300 SW. Arrowwood Dr., Portland, Oreg. 97223; Kathy Gordon, 2424 NW. Northrup, Upper, Portland, Oreg. 97210

[21] Appl. No.: 601,185

[22] Filed: Mar. 14, 1996

[51] Int. Cl.[6] ..... A42B 1/06

[52] U.S. Cl. ..... 2/195.8; 2/171; 2/207

[58] Field of Search ..... 2/171, 171.03, 2/181, 206, 207, 195.8; D2/889

[56] References Cited

U.S. PATENT DOCUMENTS

| | | | |
|---|---|---|---|
| 975,582 | 11/1910 | Swindell | 2/195.8 X |
| 1,040,461 | 10/1912 | Thorpe . | |
| 1,205,403 | 11/1916 | Smolin . | |
| 1,503,537 | 8/1924 | Knopfler . | |
| 1,512,128 | 10/1924 | O'Brien . | |
| 1,532,750 | 4/1925 | Joha . | |
| 1,618,222 | 2/1927 | Phillips et al. . | |
| 1,720,560 | 7/1929 | Lipper | 2/195.8 |
| 2,420,378 | 5/1947 | Lehman et al. | 2/195.8 X |
| 3,287,737 | 11/1966 | Schuessler | 2/206 |

*Primary Examiner*—C. D. Crowder
*Assistant Examiner*—Shirra L. Jenkins
*Attorney, Agent, or Firm*—William S. Lovell

[57] ABSTRACT

A stocking cap includes a tail adapted for encircling the neck and then being attached near the distal end thereof to the side of the cap so as to serve as a scarf. Included in the tail is a slot body containing a slot, and then a cord, so that by passing a length of cord through the slot there is formed a loop that can be placed around a button on the side of the cap. By such means, a tassel or the like disposed at the end of the cord can be made to fit snugly against the head. Additional embodiments are formed by variations in the width of the tail, a first variation being initially wide, then narrow, and then wide so as to cover one ear region, the neck and chin, and then the second ear region, and a second variation being wider near the center and having an elongate slit therein for the mouth so as to provide a ski mask.

11 Claims, 4 Drawing Sheets

STOCKING CAP WITH TAIL SERVING AS A WRAP-AROUND END-ATTACHABLE SCARF AND/OR SKI MASK

BACKGROUND OF THE INVENTION

1. Field of the Invention

This invention relates to head gear, specifically to soft-fabric head gear such as knitted caps of the "stocking cap" variety, and more specifically to include an elongate tail that may function as a scarf for wrapping around the neck or as a ski mask to cover the lower face.

2. Background Information

Particularly in regions having cold, inclement weather, it has long been customary to provide head gear that will protect most of the head, but often excluding the face and neck, from such weather. Further, it is customary separately to provide scarves or similar implements of clothing to protect the neck, or a ski mask to protect the face, from such inclement weather. Some effort has likewise been made to provide weather protection for both the head and neck in a single implement of clothing.

Thus, U.S. Pat. No. 1,040,461 issued Oct. 8, 1912 to Thorpe describes an implement of clothing that may serve both as a cap and a hood. At the lower end of a crocheted or knitted cap there is included a first band having elongate extensions that may be buttoned together when such band is extended downward to encircle the neck in the manner of a scarf. The front peak of the cap includes a second band that may be buttoned backward onto the body of the cap when that first band is used as a scarf as just indicated, or those first and second bands may be buttoned together so that the implement of clothing in such case acts as a cap.

U.S. Pat. No. 1,503,537 issued Aug. 5, 1924 to Knopfler describes a soft cap having flaps on opposite sides thereof that may be folded upwardly and buttoned together near the cap crown so as to serve as a cap; folded backwardly and buttoned together to serve as a cap having a protective extension over the back of the neck; or folded frontwardly to serve as a cap having a frontward extension encircling the neck in the manner of a scarf.

U.S. Pat. No. 1,512,128 issued Oct. 21, 1924 to O'Brien describes another soft cap having at the back and sides thereof a combination of a muffler member and a pair of opposite ear flaps. The muffler/ear flap combination may be folded down and attached beneath the chin and against the front of the neck to cover the ears, the back of the head and the neck, or the ear flaps may be folded down separately and connected, so as to leave the neck uncovered.

Similar to the O'Brien patent, U.S. Pat. No. 1,532,750 issued Apr. 7, 1925 to Joha describes head gear that likewise has ear flaps and a piece adapted to encircle the back of the neck. The ear flaps in this case include button holes that attach to buttons located on either side of the crown. U.S. Pat. No. 1,618,222 issued Feb. 22, 1927 to Phillips et al. is similarly constructed.

The traditional "stocking cap" is also a well-known item of head gear. For such purposes as skiing and the like, the "tail" of the stocking cap acts to provide a certain "flair" to the endeavor, and (fortuitously) to provide a wrap around the neck for purposes of warmth and protection. To applicant's knowledge, however, there has been no effort to develop a stocking cap in which the tail thereof is specifically adapted in size and configuration to be useable as a scarf or muffler around the neck, and in particular to be adapted for fastening in such a configuration by convenient means that will yet preserve the aesthetic purpose of the head gear. Further, applicant is unaware of any head gear that also provides intrinsic means for using a tail thereof alternatively as a ski mask.

More specifically, a common feature in the head gear indicated in the prior art above is that each type of head gear is constructed so as to lack cylindrical symmetry, which thereby renders that head gear difficult to use for more than the single purpose for which it was designed. Even in caps that have loosely been termed "stocking caps" there does not exist a structure comparable to an actual long stocking, in that the "tail" (or "lower leg," in the case of an actual stocking) will have a structure that is not cylindrically symmetrical. It would be of great advantage, therefore, to provide a head gear that indeed exhibits cylindrical symmetry and, depending upon the severity of the weather in a particular instance, could thus be used initially as a basic stocking cap, as a cap-and-scarf combination in more inclement weather, and as a cap-and-ski-mask apparatus in the most inclement weather.

SUMMARY OF THE INVENTION

The invention comprises a stocking cap having a tail that can serve as a warming scarf that wraps around the neck or under the chin and is attached back to the cap by buttoning or the like, or preferably by loop means whereby a tassel that terminates the tail becomes conveniently and artistically disposed. Except for the attachment of one or more buttons, both the body of the cap and the tail are symmetrical about a common axis, with the result that the tail can be turned downward from the top of the head in any direction so as to make possible different uses of the cap. The tail can be made in a variety of dimensions, and includes near the terminus thereof a slot that can serve as a button-hole. However, the tail will preferably include a cord that extends outwardly therefrom and that can be looped back through the slot so as to be placed around a button on a side of the cap, said cord itself preferably terminating in a decorative element such as a tassel. By such means, the remaining cord and tassel are left to hang aesthetically downward on one side of the cap, rather than to extend awkwardly upward and then curl downward in an unpleasant manner. In one possible set of dimensions, the tail is made broad near either end thereof, and narrow in the middle, so as to be drawn down over the side of the head to cover one ear, the neck and chin, and then the other ear. Alternatively, the tail is made broad enough near the central portion thereof to be drawn up over the face as a ski mask, in which case there is incorporated along the longitudinal dimension of the tail a second slit that can serve as a mouth slit. Of course, both such uses are also possible using a tail of a single width, given the flexible nature of the knitted or similar fabric of which the invention is made.

Another advantage of having such a multi-use structure is that upon a user coming inside out of the cold, the tail, whether having been used as a scarf or a ski mask, is simply unfastened to hang downward from the cap, and there is no separate scarf or ski mask that must be put away or possibly misplaced.

BRIEF DESCRIPTION OF THE DRAWINGS

The preferred embodiments of the invention will now be described in detail with reference to the accompanying exemplary drawings, in which.

DETAILED DESCRIPTION OF THE INVENTION

Figure 1:
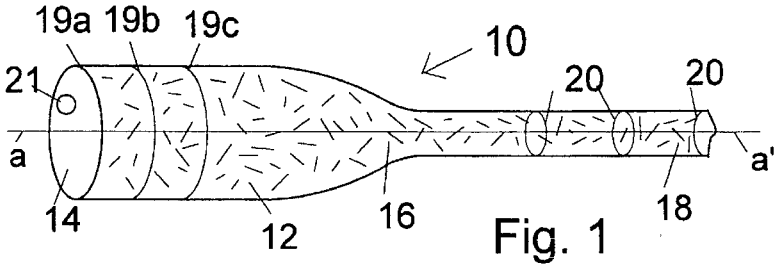
FIG. 1 shows in perspective the structural feature of cylindrical symmetry of the body and tail portions of a preferred embodiment of the invention.

FIG. 1 shows in perspective and in elongate form a portion of a preferred embodiment of head gear 10, which is preferably made into a highly flexible structure as by knitting. As can be seen, head gear 10 includes a hollow, cylindrical body 12; an interior end portion that Shall be folded outwardly so as to become an external band 14 as will be described hereinafter; at an end of body 12 opposite band 14 an inwardly tapering portion that shall similarly be formed into crown 16; and a tail 18.

Also shown in FIG. 1 is a circular terminus **19*a* which, because of the flexible nature of head gear 10, can be folded outwardly and then back over the exterior of body 12, e.g., at fold line 19*b*, so as to become coincident with band line 19*c*. Band 14 is thus formed thereby, as is shown in FIGS. 2A–2D. Band 14 also has attached thereon one or more buttons 21, for purposes that will be described below. Band 14**, which may also be turned downwardly so as to cover a larger portion of the head of a user, is not essential to the invention, however.

Even so, when terminus **19*a* has been folded back to become coincident with band line 19*c* as described, body 12 assumes a hollow, bottle-shaped form, and by turning tail 18 downwardly, (opposite the original direction thereof) body 12 assumes a hollow, cup-shaped form, and the inwardly tapering portion of body 12 that is opposite terminus 19*a* becomes crown 16. The manner in which head gear 10**, by virtue of its flexible nature, can thus be manipulated from a simple quasi-cylinder into a useful item of head gear permits inclusion of additional features.

Figures 2A, 2B, 2C, 2D:
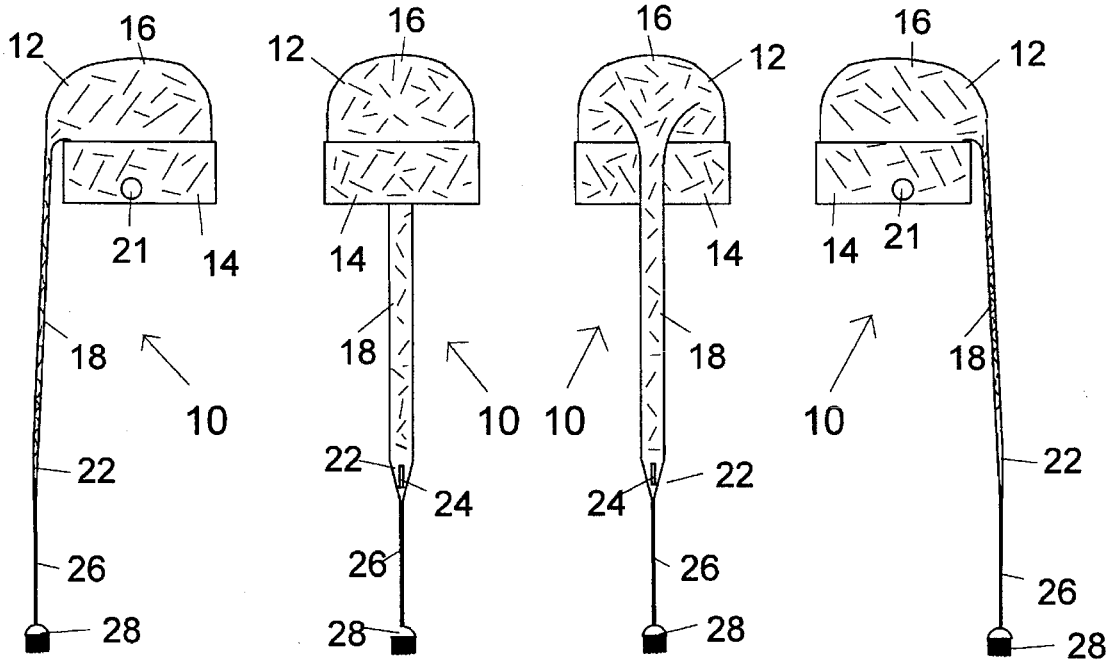
FIG. 2A shows a side elevation view of a preferred embodiment of the invention in its extended configuration as worn by a person.
FIG. 2B shows a front elevation view of the embodiment of FIG. 2A.
FIG. 2C shows a back elevation view of the embodiment of FIG. 2A.
FIG. 2D shows an opposite side elevation view of the embodiment of FIG. 2A.

FIG. 2A shows a side view of the configuration of head gear 10 when in use, wherein body 12 becomes cup-shaped in part from band 14 that encircles a lower portion of body 12. Body 12 may be of a knitted material, or of course other types of clothing fabric as are known to those of ordinary skill in the art may be used as well. Crown 16 may be formed as a continuous and essentially uniform extension of circular band 14 and thence body 12, then being flared inwardly so as to form the indicated cup shape. Of course, band 14 and crown 16 may also be formed separately and then be attached edgewise to body 12 as by sewing, or band 14 may simply comprise a band region disposed onto body 12 opposite crown 16.

Extending outwardly and downwardly from the portion of crown 16 that is opposite band 14 is a tail 18, which is preferably formed as a continuation of crown 16 that tapers further inwardly so as to develop a structure that is essentially tubular. Tail 18 will preferably be of a length proportionate to the size of body 12, i.e., assuming that body 12 has been fabricated with dimensions that will fit a person of some given hat size, tail 18 will preferably be made of a length to permit wrapping the same around the neck of a person of a physical size that would accommodate the given hat size, tail 18 ultimately being extendible back up to the side of body 12 as will be described hereinafter. The use of knitted materials that can be stretched provides the advantage that head gear 10 may be fabricated in a limited number of sizes, e.g., infant, child, and adult, so as to achieve a comfortable fit on any particular individual within the appropriate one of those sizes. The head gear is made from a flexible material so that the tail can drape in a direction essentially parallel to a longitudinal axis of the body.

Given that the location of tail 18 may define the "back" of head gear 10, approximately midway towards the front of head gear 10 on either side thereof, and disposed outwardly from band 14, there can be placed a pair of buttons 21. Of course, a single button so placed can be used as well, but the use of an oppositely directed pair of buttons permits the user of head gear 10 to carry out the wrapping of tail 18 as will be described hereinafter on either side, as may be best suited to the left- or right-handedness of the user or for other such reasons. At the same time, it will be shown below that because of the cylindrical symmetry of body 12, crown 16 and tail 18, for different uses tail 18 can be allowed to fall downward in any direction relative to one or more buttons 21 disposed on band 14.

Figure 3:
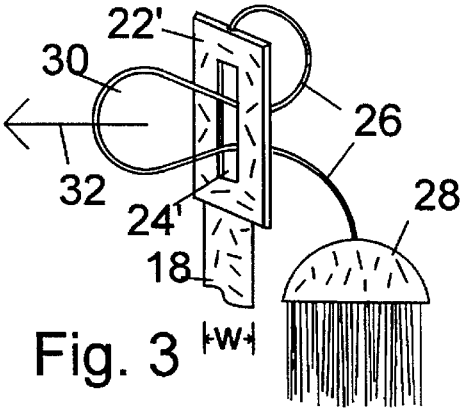
FIG. 3 shows an alternative form of tail, loop slot and cord that may be used in the embodiment of FIG. 2A.

At the distal end of tail 18 provision is made for a slot body 22 as shown in FIGS. 2A–2D, within which is disposed a loop slot 24 (visible only in the front and back views of head gear 10 as depicted in FIGS. 2B and 2C). Slot body 22 may be made as an inwardly tapering continuation of the tail as shown in FIGS. 2A–2D, in which case the material of slot body 22 may be yet more knitted material. Alternatively, a flat, rectangular slot body 22' as shown in FIG. 3 may be used, for which such materials as leather may also be employed, but including a similar loop slot 24'. Then the slot body may be formed separately and then attached to the distal end of the tail. The length of the loop slot preferably lies parallel and near the longitudinal axis of the slot body.

Extending yet further outwardly from the distal end of tail 18 is firstly a cord 26 attached to slot body 22 (or 22') opposite tail 18, and secondly a tassel 28 attached to the distal end of cord 26. Tassel 28 may of course be formed in a variety of different styles, or may be replaced by other functionally equivalent but aesthetically different devices. In any case, cord 26 is of a size that will allow the same to be passed through loop slot 24 (or 24') to form a loop 30 as shown in FIG. 3, and then tassel 28 or the like serves to fix the extent of loop 30, i.e., tassel 18 is preferably of a size to preclude passage through loop slot 24 (or 24'). Loop slot 24 (or 24') is preferably of a size both to permit the formation therethrough of a loop as just stated, or alternatively to permit passage therethrough of a button 21, i.e., loop slot 24 (or 24') would in such case be used simply as a button hole.

In lieu of using loop slot 24 (or 24') as a button hole, loop 30 is made instead as stated above, and is looped about button 21 in the direction of arrow 32. In this way, the size of buttons 21 is not limited to a corresponding size at which loop slot 24 or 24' (when used simply as a button hole) can be made as a practical matter, given a width W of tail 18 as shown in FIG. 3, but instead button(s) 21 may be made larger and given decorative features for aesthetic reasons. To illustrate further the utility of such a procedure, a use of loop slot 24 (or 24') directly as a button hole is shown first below in FIGS. 4A–4B.

Figure 4A:
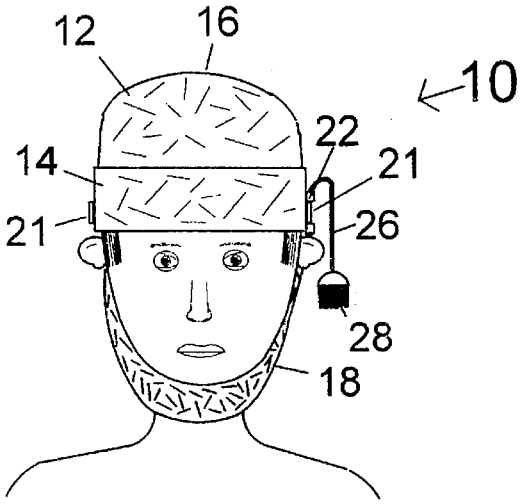
FIG. 4A shows a front view of the embodiment of the invention of FIG. 2A as worn by a person wherein the loop slot is used as a button hole.
Figure 4B:
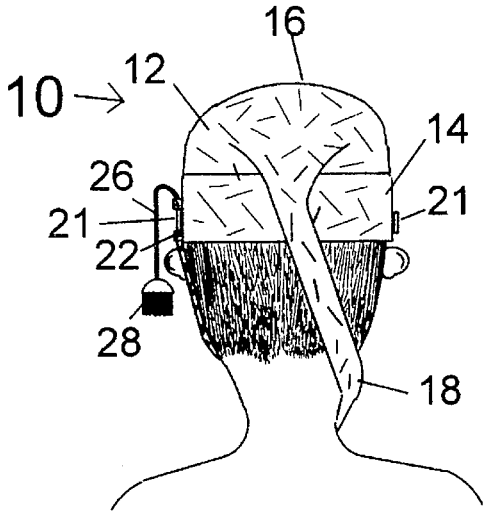
FIG. 4B shows a back view of the embodiment of the invention of FIG. 2A as worn by a person wherein the loop slot is used as a button hole.

As illustrated in FIG. 4A, for example, when slot body 22 is attached directly to button 21, cord 26 extends upwardly therefrom and by the weight of tassel 28 then fails both downwardly and outwardly, so as not only to be placed outward from the head but also to have a free length of cord 26 that may cause physical or psychological irritation if that free length of cord 26 and also tassel 28 are allowed to swing back and forth against the ear. FIG. 4B shows the same configuration in a view from in back of the user.

Figure 5A:
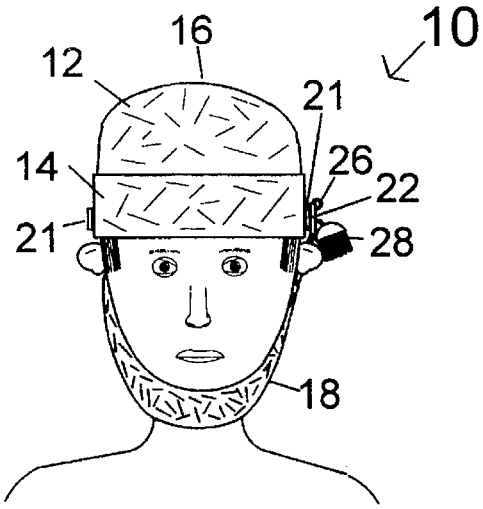
FIG. 5A shows a front view of the embodiment of the invention of FIG. 2A as worn by a person wherein a cord loop is formed to encircle the button.
Figure 5B:
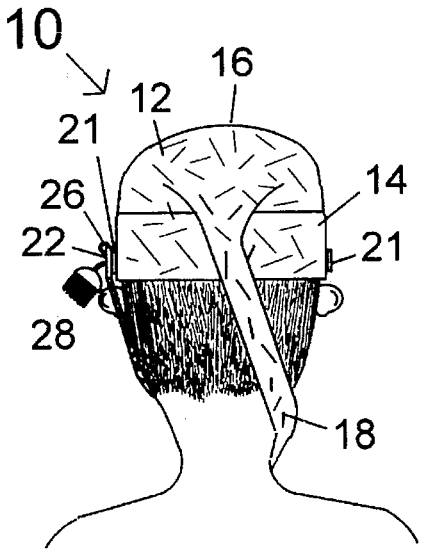
FIG. 5B shows a back view of the embodiment of the invention of FIG. 2A as worn by a person wherein a cord loop is formed to encircle the button.

In FIGS. 5A and 5B, on the other hand, it is seen that by using cord 26 to form cord loop 30 as previously described, the much shorter remaining length of cord 26 that extends outward from slot body 22 now extends downwardly, and moreover tassel 28 is disposed directly near to slot body 22 so that, by appropriate prior fitting of the actual length of cord 26, tassel 28 may be made to fit snugly against slot body 22 so as to provide yet another decorative feature to head gear 10 that does not at the same time swing free.

In all of FIGS. 4A–5B, additional clothing that would be worn in inclement weather, such as a coat having a collar that would protect the lower part of the neck, are not shown for purposes of clarity in illustrating the invention, which in the embodiment shown is again intended primarily to provide protection to the neck, and particularly to the front of the neck under the chin.. Moreover, the width W of tail 18 as shown in FIG. 3 has also been shown as being somewhat narrow, again for ease of illustration. As would be understood by a person of ordinary skill in the art, however, tail 18 as shown in FIGS. 4B and 5B may easily be made rather wider so as, e.g., to provide greater protection to the back of the neck, or alternatively tail 18 may be made wider in the initial region thereof for such purpose, and then tapered to a narrower width in the region thereof that falls under the chin.

Figure 6:
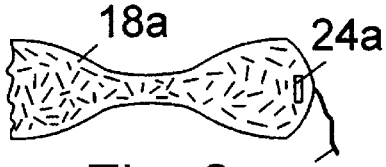
FIG. 6 shows an embodiment of the tail having broad end portions to provide a covering for the ears of a user.

A first such variation in the structure of head gear 10 is shown in FIG. 6. As was noted earlier, the cylindrically symmetrical structure of head gear 10 permits a tail 18 to be turned downward from crown 16 in any direction. Consequently, in FIG. 6 tail 18*a* is shown to be made rather wider initially, narrow in a central portion, and then wide again to incorporate a loop slot 24*a* and terminate in cord 26. The effect of turning such a tail 18*a* from a side of the head opposite button 21 (rather than 90° therefrom as shown in FIGS. 2A and 2D) is shown in FIGS. 7A–7D.

Figure 7A:
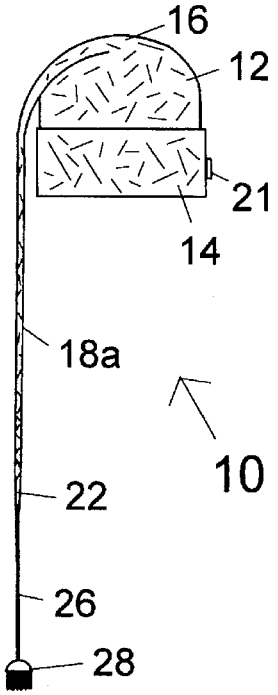
FIG. 7A shows a front view of the embodiment of FIG. 6 in which the tail is allowed to descend along one side of the head of a user.
Figure 7B:
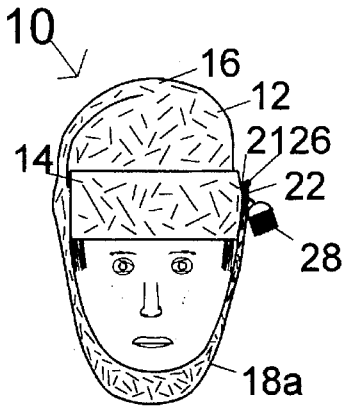
FIG. 7B shows a front view of the embodiment of FIG. 7A in which the tail has been crossed under the chin and loop-connected to the opposite side.
Figure 7C:
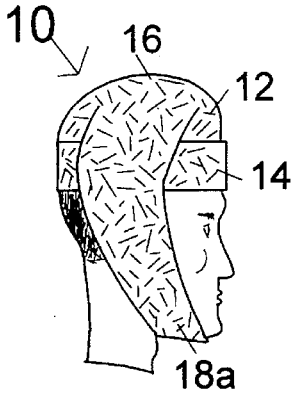
FIGS. 7C and 7D show left and right profile views of the embodiment of FIG. 7B.
Figure 7D:
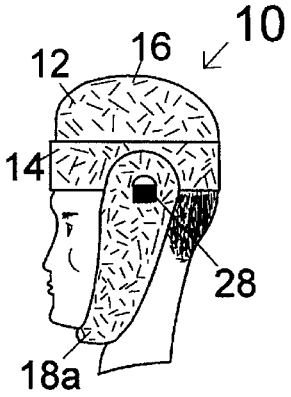

In FIG. 7A, tail 18*a* is shown to descend from crown 16 at a location that is opposite to the position of button 21 on band 14. In FIG. 7B, head gear 10 is shown in use, wherein tail 18*a* has been wrapped around under the chin and fastened to button 21 as previously described, i.e., by looping cord 26 through slot body 22 (slot body 24 is not visible in this drawing) so as to leave tassel 28 snug against the side of the head. Left and right side elevation views of head gear 10 as so disposed are shown in FIGS. 7C and 7D. The particular shape that is given to tail 18*a* is of course exemplary only, e.g., tail 18*a* could be made wider so as to cover a larger portion of the face.

Figure 8:
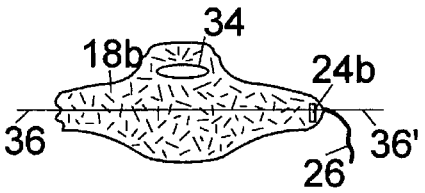
FIG. 8 shows an embodiment of the tail having a broad central portion including a mouth slit so as to provide a ski mask.
Figure 9:
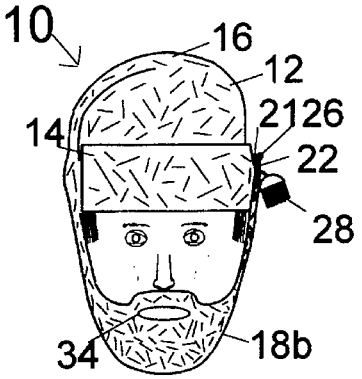
FIG. 9 shows a front view of the embodiment of FIG. 8 wherein the tail has been connected across the head of a user so as to function as a ski mask.

In FIG. 8, tail 18*b* is shown as being narrower at the ends and wide in a central portion that also includes therein a mouth slit 34. This slit is displaced to one side of the central longitudinal axis of the tail. In FIG. 9, tail 18*b* has been wrapped around the chin and face and fastened to button 21 as in FIG. 7B, but in this case tail 18*b* serves as a ski mask to cover not only the chin but also a portion of the face. Again, the precise shape of tail 18*b* may be varied, e.g., for the most inclement weather the upper (in FIGS. 8 and 9) side of tail 18*b* could be made more extensive so as to cover over the cheek bones up to near the eyes. Alternatively, for aesthetic reasons tail 18*b* can be made quite symmetrical, i.e., so that the sides thereof above and below the plane 36-36' could be made as mirror images (except for the presence on one side thereof of mouth slit 34).

From the foregoing, it is then apparent that through the concept of adapting a tail of a stocking cap to serve additional protective purposes, and further by constructing such stocking cap to have cylindrical symmetry throughout the body and tail thereof, while also providing means for convenient and aesthetic connection of the tail back onto the cap, a number of different clothing embodiments can be constructed. It will thus be understood by those of ordinary skill in the art that those and similar such other arrangements and disposition of the aforesaid components, the descriptions of which are intended to be illustrative only and not limiting, may be made without departing from the spirit and scope of the invention, which must be identified and determined only from the following claims and equivalents thereof.

We claim:

1. A stocking cap comprising:

an elongate, cylindrical body;

a band region encircling one end of said body;

at least one button attached to an outward side of said band region;

an elongate, cylindrical tail having a proximal end and a distal end attached to said body opposite said band region;

a slot body near the distal end of said tail and containing an elongate loop slot;

a cord attached to the distal end of said slot body; and a tassel body attached to the distal end of said cord.

2. The stocking cap of claim 1 formed of a flexible material to permit turning said tail outwardly and downwardly opposite an original direction thereof so as to drape in a direction essentially parallel to a longitudinal axis of said body.

3. The stocking cap of claim 1 wherein said band region is formed by folding an end portion of said body outwardly and thence back around said body.

4. The stocking cap of claim 1 wherein said tail is formed as an inwardly tapering continuation of said body.

5. The stocking cap of claim 1 wherein said slot body is formed as an inwardly tapering continuation of said tail.

6. The stocking cap of claim 1 wherein said slot body is separately formed and is attached to the distal end of said tail.

7. The stocking cap of claim 1 wherein the long dimension of said loop slot lies parallel to and near to a longitudinal axis of said slot body.

8. The stocking cap of claim 1 wherein from a crown region adjacent said body said tail tapers inwardly near a central portion thereof to establish an essentially constant width of said central portion, and then tapers outwardly to a width near to that of said crown region.

9. The stocking cap of claim 1 wherein from a crown region adjacent said body said tail tapers outwardly near a central portion thereof to establish an essentially constant width of said central portion, and then tapers inwardly to a width near to that of said crown region.

10. The stocking cap of claim 9 further comprising an elongate slit lying parallel to but displaced to one side of a central longitudinal axis of said tail.

11. A method of attaching a distal end of a tail of a stocking cap to a side of a band encircling said stocking cap, comprising:

providing at least one button on an outward side of said band;

providing near the distal end of said tail an elongate loop slot;

attaching a cord to the distal end of said tail, said cord being of a width to permit passage through said loop slot;

attaching a tassel body to the distal end of said cord, said tassel body being of a width to preclude passage through said loop slot;

forming a loop from said cord by passing a portion thereof through said loop slot; and encircling said loop about one of said one or more buttons.

* * * * *